US008196353B2

(12) United States Patent
Loidolt

(10) Patent No.: US 8,196,353 B2
(45) Date of Patent: Jun. 12, 2012

(54) GUIDING MECHANISM FOR SLIDING LEAVES OR SLIDING DOORS

(75) Inventor: Peter Loidolt, Fladnitz (AT)

(73) Assignee: Ceta Elektromechanik GmbH, Fladnitz (AT)

( * ) Notice: Subject to any disclaimer, the term of this patent is extended or adjusted under 35 U.S.C. 154(b) by 0 days.

(21) Appl. No.: 11/995,054

(22) PCT Filed: Jul. 7, 2006

(86) PCT No.: PCT/EP2006/006687

§ 371 (c)(1),
(2), (4) Date: Jan. 8, 2008

(87) PCT Pub. No.: WO2007/006515

PCT Pub. Date: Jan. 18, 2007

(65) Prior Publication Data

US 2008/0202032 A1 Aug. 28, 2008

(30) Foreign Application Priority Data

Jul. 8, 2005 (DE) ..... 10 2005 032 327
Sep. 29, 2005 (EP) ..... 05021280

(51) Int. Cl.
*E05D 15/06* (2006.01)

(52) U.S. Cl. ..... 49/404; 49/425

(58) Field of Classification Search ..... 49/404, 49/410, 411, 425, 427, 49; 16/91, 99, 100, 16/105, 106; 4/557, 607
See application file for complete search history.

(56) References Cited

U.S. PATENT DOCUMENTS 443,990 A * 1/1891 Dellieres et al. ..... 49/410
558,474 A * 4/1896 Bierbach ..... 49/410
599,083 A * 2/1898 Westin et al. ..... 49/123
1,172,711 A * 2/1916 Hunter ..... 312/333
1,610,282 A * 12/1926 Hansen ..... 49/410
1,702,799 A * 2/1929 Shonnard ..... 16/106
3,509,665 A * 5/1970 Bartlett et al. ..... 49/410
3,705,468 A * 12/1972 Ashworth ..... 49/409
3,929,387 A * 12/1975 Grass ..... 384/19
3,954,315 A * 5/1976 Sanden ..... 312/333
4,330,960 A * 5/1982 Hasemann et al. ..... 49/404
4,336,670 A * 6/1982 Brutosky ..... 49/409
4,621,876 A * 11/1986 Reimer ..... 312/330.1

(Continued)

FOREIGN PATENT DOCUMENTS

DE 3619516 A1 * 12/1987
DE 4137442 A1 7/1992
DE 44 41 152 12/1995

(Continued)

OTHER PUBLICATIONS

Japan Office action of Jul. 19, 2011 in counterpart Japanese Patent Application No. 2008-519871 along with an English translation thereof.

*Primary Examiner* — Jerry Redman

(74) *Attorney, Agent, or Firm* — Greenblum & Bernstein, P.L.C.

(57) ABSTRACT

The invention relates to a guiding mechanism for sliding devices, especially leaves or doors. Said guiding mechanism comprises a profiled guide rail which is mounted on rolls or sliding elements and is optionally fitted with a superstructure. A stationary roll support and at least one movable roll support are provided. The movable roll support is moved into the operating position thereof substantially without producing a load moment.

18 Claims, 9 Drawing Sheets

U.S. PATENT DOCUMENTS

| | | | | | |
|---|---|---|---|---|---|
| 4,872,287 | A | * | 10/1989 | Block | 49/449 |
| 5,048,232 | A | * | 9/1991 | Miyagawa et al. | 49/440 |
| 5,791,089 | A | * | 8/1998 | Prevot et al. | 49/425 |
| 5,950,279 | A | * | 9/1999 | Chaput | 16/105 |
| 6,025,685 | A | * | 2/2000 | Parsadayan | 318/471 |
| 2006/0230683 | A1 | * | 10/2006 | Hung | 49/409 |
| 2006/0230684 | A1 | * | 10/2006 | Poole | 49/409 |
| 2008/0226391 | A1 | * | 9/2008 | Phillips et al. | 404/6 |

FOREIGN PATENT DOCUMENTS

| | | | | |
|---|---|---|---|---|
| DE | 298 17 083 | | | 2/1999 |
| EP | 0279155 | B1 | | 8/1988 |
| EP | 0760415 | A1 | | 3/1997 |
| JP | 62-79075 | | | 5/1987 |
| JP | 02054077 | A | * | 2/1990 |
| JP | 04149387 | A | * | 5/1992 |

* cited by examiner

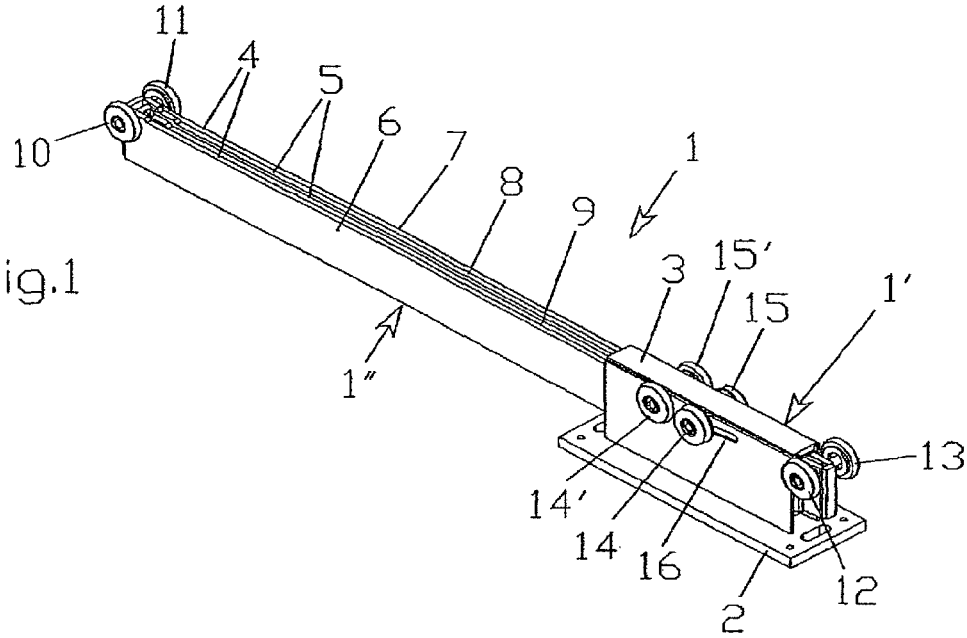
Fig.1
Fig.2
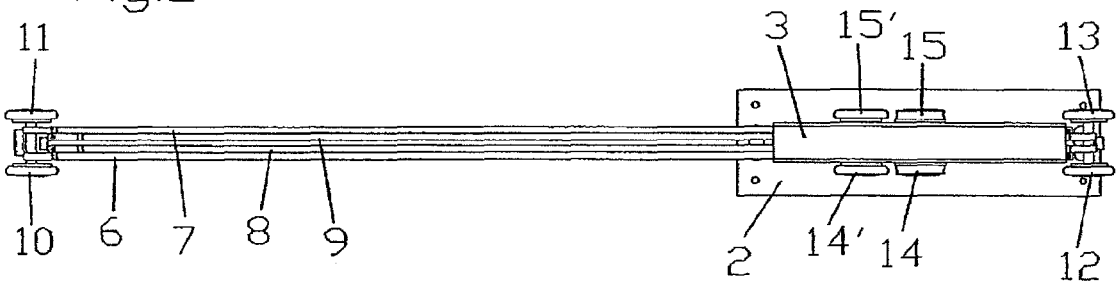
Fig.3
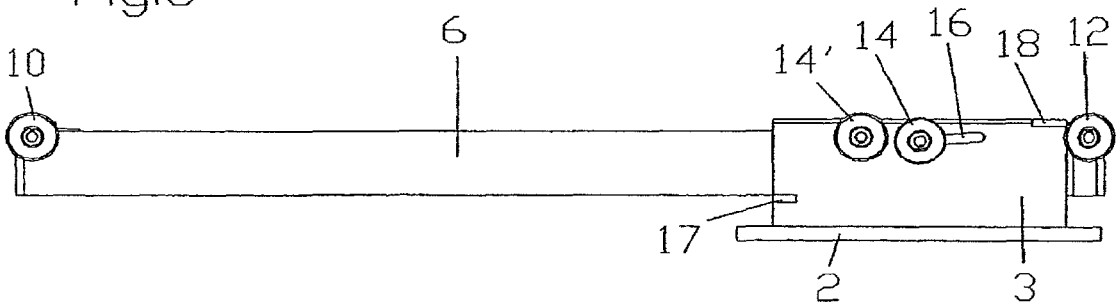

1*
2
5'
6
7
10
11
12
13
14
15

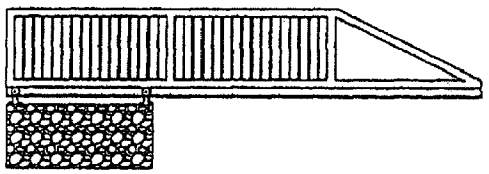
Fig. 15a Prior Art
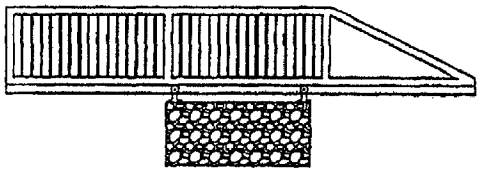
Fig. 15b Prior Art
Fig. 15c Prior Art
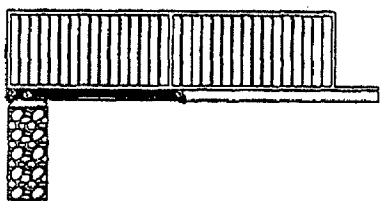
Fig. 16a
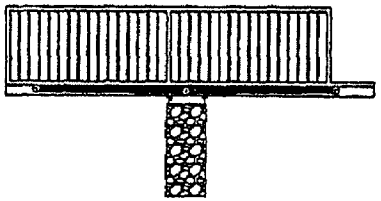
Fig. 16b
Fig. 16c
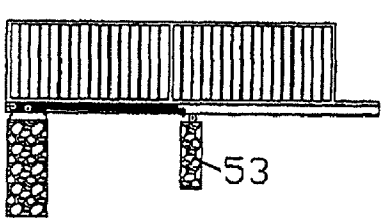
Fig. 17a
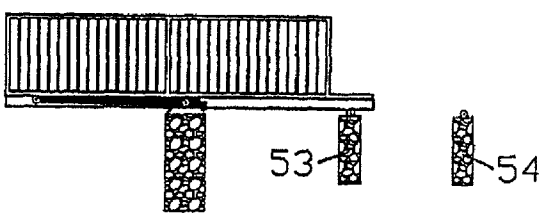
Fig. 17b
Fig. 17c

GUIDING MECHANISM FOR SLIDING LEAVES OR SLIDING DOORS

CROSS-REFERENCE TO RELATED APPLICATIONS

The present application is a U.S. National Stage of International Patent Application No. PCT/EP2006/006687 filed Jul. 7, 2006, and claims priority under 35 U.S.C. §119 and 365 of German Patent Application No. 10 2005 032 327.8 filed Jun. 8, 2005 and of European Patent Application No. 05 021 280.2 filed Sep. 29, 2005. Moreover, the disclosure of International Patent Application No. PCT/EP2006/006687 is expressly incorporated by reference herein in its entirety.

BACKGROUND OF THE INVENTION

1. Field of the Invention

The invention relates to a guiding mechanism for sliding action arrangements, in particular leaves or doors, having a running-rail profile which is mounted on rollers or sliding elements and is possibly provided with a superstructure.

2. Discussion of Background Information

In the case of known guiding mechanisms of the above-mentioned type, as are customary nowadays, for example, in sliding-door construction, the actual door is additionally accompanied by the clamping-in part which is necessary for functioning. Thus, for example in the case of EP 0 279 155 B1, a sliding door comprises, as a carrier for a box profile, two roller blocks which are arranged at a distance apart from one another in a direction transverse to the passageway which is to be closed off, and outside this passageway. The roller blocks each bear a top pair of rollers and a bottom pair of rollers, which are designed as grooved rollers. The top grooved rollers engage in two parallel ribs in the top box-profile wall, while the bottom grooved rollers are guided in two parallel ribs in the bottom box-profile wall, in the vicinity of a longitudinal slot in the box profile. The box profile extends from the front door edge to the outer roller block. This results in the door being extended to a quite significant extent, with adverse effects on the use of materials, the transporting costs, operational costs, space required for installation and the appearance. The lever formation in these constructions is likewise disadvantageous, as a result of which the door statics, the running-rail profile and the running rollers have to meet stringent requirements.

If there is a shortage of space, solutions which provide telescopically displaceable doors with movable roller carriers are already known, for example from DE 41 37 442 A1. This known sliding door has two panels. The first panel, comprising two panel parts, is supported such that it can be displaced via bearing blocks fastened on the ground. The second panel is provided between the two panel parts. The second panel is guided such that it can be displaced via two roller blocks which are borne by plates which are fastened on guide rails of the panel parts of the first panel and connect these rails to one another. A drive is provided in order to open and close the sliding door, and the drive causes the first panel to move in a controlled manner in relation to the second panel. In the case of such doors, the door and the running rollers are subjected basically to the same loading as in the case of the first-mentioned guiding mechanism.

SUMMARY OF THE INVENTION

The invention provides a guiding mechanism of the above-mentioned type in which the leverages are more favorable and, accordingly, the loading to which the rollers and roller bearings are subjected, and the bowing of the door and running rail, are reduced.

According to embodiments, a stationary roller carrier and at least one movable roller carrier are provided, and the movable roller carrier is moved into its operating position in a manner essentially free of load moments.

This means that essentially just a single carrier, instead of the 2 rolling blocks, is required for the door, and lower loading on the rollers and roller bearings can be achieved by the displaceable lever construction formed by the carrying arms.

The invention can be used not just for doors but also, for example, in rack and shutter systems, canopies, coverings, mobile bridges, working and formwork platforms, moles for tunneling and advance working machines for mining, pull-out and push-out mechanisms in mechanical engineering and equipment construction and also partitions and furniture.

According to an expedient, further embodiment of the invention, the movable roller carrier is mounted in a displaceable manner in an open, partially open or closed housing provided in the stationary roller carrier, and it can be anchored for its operating position.

An expedient, further embodiment of the invention provides a second movable roller carrier which is mounted such that it can be displaced in the opposite direction to the first movable roller carrier and which can be anchored for its operating position.

According to an expedient, further embodiment of the invention, the movable roller carrier can be recessed wholly or partially in the ground and can be moved from there, by means of suitable control, coupling and drive elements, into its operating position.

According to an expedient, further embodiment of the invention, one or more rollers can be adjusted vertically and/or horizontally on the stationary roller carrier.

According to a further embodiment of the invention, the second carrying arm comprises two spaced-apart, parallel and interconnected second plates. The torsional rigidity of the second carrying arm can be increased in this way.

According to a further embodiment of the invention, a further one of the pairs of rollers is fitted in a stationary manner on the housing. These serve, inter alia, for shifting weight during door movement, and the loading on the roller bearings can thus be reduced yet further in some cases.

According to a further embodiment of the invention, the further pair of rollers is fitted on the housing such that it can be adjusted essentially in the longitudinal direction of the housing. The further pair of rollers can thus be adapted to the box profile and space can be saved.

According to a further embodiment of the invention, the carrying arms are guided on bearing elements fitted in the housing. These bearing elements are preferably plate bearings. In some cases, it may be advantageous to use these, or combine them, with roller bearings.

According to an expedient, further embodiment of the invention, the carrier comprises an installation plate which can be fastened on the ground and bears the housing.

BRIEF DESCRIPTION OF THE DRAWINGS

The invention will now be explained in more detail with reference to exemplary embodiments. In the figures:

FIG. 1 shows a perspective view of a carrier for a running-rail profile of a self-supporting sliding door according to the invention, FIG. 2 shows a plan view of the carrier from FIG. 1, FIG. 3 shows a side view of the carrier from FIG. 1, FIGS. 15*a*-15*c* show schematic side views of a door according to the prior art, similar to EP 0 279 155 B1, for comparison with the invention, FIGS. 16*a*-16*c* show schematic side views of a door with a first embodiment of a guiding mechanism according to the invention, in particular for relatively small doors, FIGS. 17*a*-17*c* show schematic side views of a door with a second embodiment of a guiding mechanism according to the invention, in particular for medium-sized doors, with just one movable roller carrier provided.

DETAILED DESCRIPTION OF THE PRESENT INVENTION

Figures 4, 5, 6:
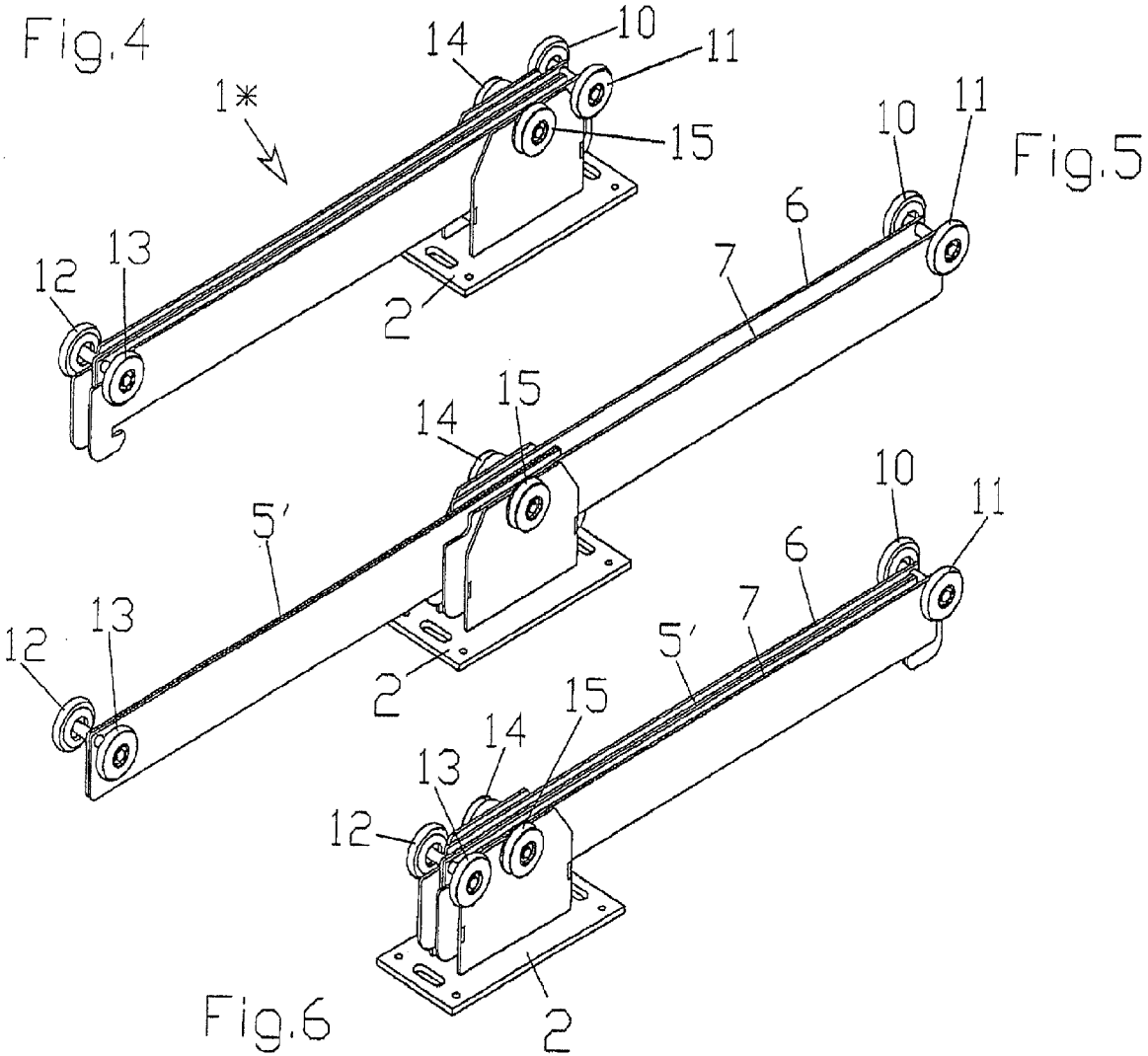
FIG. 4 shows a partial view, in perspective, of a second embodiment of a carrier for a running-rail profile of a self-supporting sliding door according to the invention with carrying arms extended to that side on which the sliding door assumes the closed position.
FIG. 5 shows a partial view, in perspective, of the carrier from FIG. 4 with carrying aims extended to both sides.
FIG. 6 shows a partial view, in perspective, of the carrier from FIG. 4 with carrying arms extended to that side on which the sliding door assumes the open position.

The most important versions of the invention are explained, in the form of simplified side views of doors with guiding mechanisms, with reference to FIGS. 16*a*-16*c*, 17*a*-17*c*, 18*a*-18*c* and 19*a*-19*c*. For comparison, FIGS. 15*a*-15*c* illustrate a door with a guiding mechanism according to the prior art. The doors here are shown in the following positions: (a) "closed", (b) "half-open" and (e) "open".

FIG. 15*a* illustrates an elongate concrete foundation 1'.sub.1 with roller blocks at the front end, at a position A, and at the rear end, at a position B. The running rollers of these rolling blocks slide in a running-rail profile 19, on which a door 49' has been constructed. As can be seen, the leverages in FIGS. 15*a* and 15*c* are very disadvantageous for the door leaf and running rollers.

Instead of installing the running rollers (or sliding elements) at the positions A and B, as has been customary up until now, the invention proposes to arrange the running rollers for example according to FIG. 16*a*, offset toward the center of gravity of the door, at a position A' and, in the region of the stationary roller carrier $\mathbf{1'}_2$, at a position B'. This measure reduces the loading to which the door and running rollers are subjected. More precisely, at the end of the door, alongside the door opening, the stationary roller carrier $\mathbf{1'}_2$ is mounted on a foundation. The associated rollers are fixed or arranged such that they can be adjusted in the region of the roller carrier for adjusting and space-saving purposes. For some applications, it may be expedient to provide for vertical adjustability or controllability (adjustability during door movement for the purpose of controlled relief of loading from carrying arms and/or shifting of weight) of the roller. A movable (displaceable) roller carrier $\mathbf{1''}_2$ supports the door in its "closed" position. In the case of relatively small doors, it is most expedient for a more or less horizontally arranged roller carrier $\mathbf{1''}_2$ to be moved from the side in the through-passage direction and to be anchored laterally in the region of the stationary roller carrier. Dimensioning has to take place such that the weight absorbed via the rollers can be managed by the roller carrier and its bearing elements. High leverages occur at the points of contact, in which case the version according to FIGS. 16*a*-16*c* can only be used up to a limited opening width.

For medium-sized doors, it is recommended to use the version which is shown in FIGS. 17*a*-17*c*, in the case of which just one removable roller carrier $\mathbf{1''}_3$ is provided and in the case of which an additional roller carrier 53 or two additional roller carriers 53, 54 are provided, these being fixed on the floor, or being arranged such that they can be extended out of the floor, and being spaced apart from one another and from the roller $\mathbf{1''}_3$. This type of construction provides the advantages according to the invention of a short door leaf and of advantageous load moments on the rollers, but the foundation here, as is also the case with the embodiment according to FIG. 14, involves more outlay than in the case of a model according to FIGS. 16*a*-16*c*.

Figures 18A, 18B, 18C:
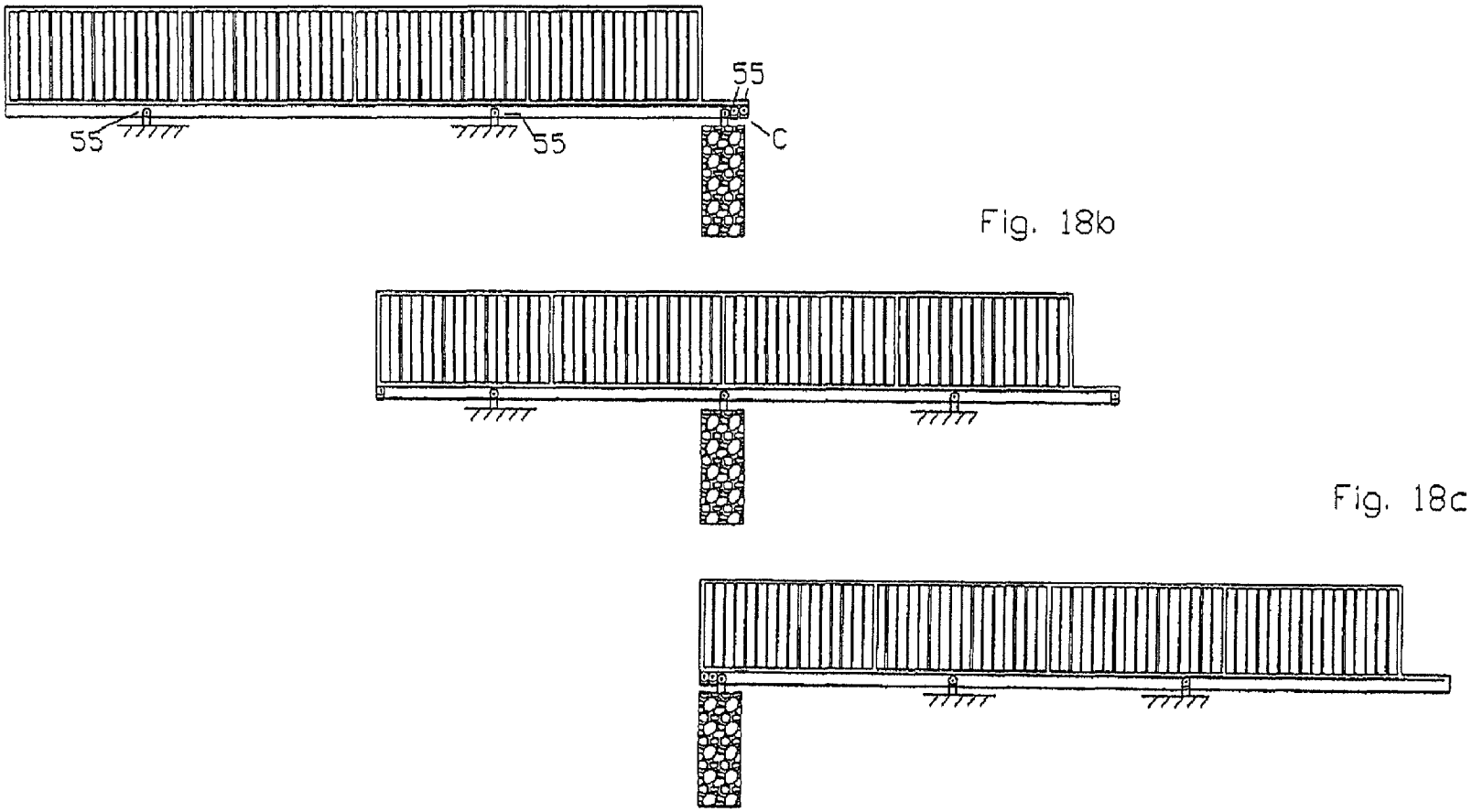
FIGS. 18*a*-18*c* show schematic side views of a door with a third embodiment of a guiding mechanism according to the invention, with the movable roller carrier(s) being configured to accompany the door movement and being arranged in the region of the running-rail profile.

For particularly large doors, it is recommended to use the version which is shown in FIGS. 18*a*-18*c*. In the case of this embodiment, movable, accompanying roller carriers, which act at a position C, have a disengagable support which is suitable for dissipating into the ground the weight which is absorbed by the running rollers 55.

The invention advantageously makes it possible to utilize the load displacement during a movement cycle. This is because this "gravitational-force control" allows the movable roller carrier to be moved without full weight loading, and thus without any significant amount of force being applied, into that position which is referred to here as the operating position and in which, once this roller carrier has been anchored, the door can support itself as soon as its center of gravity has moved beyond the running rollers responsible for shifting weight. The movable roller carriers have to be independent of one another in order for it to be possible to execute positioning which is free of load moments.

In the case of the above described sliding door, the running rollers fitted on the movable roller carriers are intended for absorbing the compressive loading, while the stationary rollers, as an abutment, have to absorb a tensile force. In the case of some door variants, the number of movable roller carriers means that tilting moments no longer occur and the stationary roller carrier, rather than being subjected to tensile forces, is then likewise subjected to compressive forces, just lateral directing forces or, temporarily, no forces at all.

The movable roller carriers have to be moved into their operating position according to the invention. This can take place in various ways. One possibility is for the movable roller carriers to be manually pulled out and set down and, if appropriate, locked. Of course, these operations may also be automated. The technical devices and associated methods are known to the person skilled in the art and need not be explained in any more detail here. Examples of a few expedient methods will be explained at a later stage in the text with reference to FIGS. 11-13.

FIGS. 1 to 3 illustrate a specific first embodiment of a guiding mechanism 1 for a running-rail profile, designed as a box profile, of a self-supporting sliding door. The guiding mechanism 1 comprises a stationary roller carrier 1' and a movable roller carrier 1". The stationary roller carrier 1' has a rectangular installation plate 2 which can be fastened on the ground and bears an elongate, open housing 3 which is in the form of an upright rectangle in cross section. In the housing 3, two carrying arms 4, 5 are guided such that they can be displaced in relation to one another, in a manner which is not illustrated. The first carrying arm 4 comprises two first plates 6, 7 which are spaced apart from one another, are parallel and are connected to one another. These first plates 6, 7 have arranged between them the second carrying arm 5, which in this case comprises two second plates 8, 9 which are spaced apart from one another, are parallel and are connected to one another. At the free end, the first plates 6, 7 bear a pair of rollers 10, 11, while the opposite end of the second plates 8, 9 bears a pair of rollers 12, 13. Furthermore, a pair of rollers 14, is fitted in a stationary manner on the housing 3. The rollers 10-15 run in longitudinal grooves of the running-rail profile of the sliding door, as will yet be explained in more detail.

The pair of rollers 14, 15 is fitted in a slot 16, running essentially in the longitudinal direction of the housing 3, and is secured in an adjustable manner in this slot 16, in which case it can be adapted to the running-rail profile. The further pair of rollers 14', 15' is expedient, in particular, when, on account of the length ratios between the running rail and a movable roller carrier, the shifting of weight of the running rail has to take place in the region of the housing 3 rather than via a pair of rollers of a displaceable roller carrier. In this context, it may be advantageous for the outer sides of the running rail to be curved upward to a slight extent. As FIG. 3 shows, bearing elements 17, 18 are provided for mounting the carrying arms 4, 5. These bearing elements are not shown specifically, but can preferably be formed by solid plates. If use is made here, for the purpose of improving the sliding movement of the displaceable roller carrier, of roller bearings, these should be installed with spring mounting in order that the high leverages which occur in the operating position can be absorbed by the plate bearings, which are fitted at a somewhat lower level and can be subjected to high loading.

FIGS. 1 to 3 show the carrier 1 in a position in which the sliding door is closed. If the sliding door is opened, then the second carrying arm 5 is displaced, in the first instance, with the pair of rollers 12, 13 to the right, whereupon, once the door has moved, the first carrying arm 4, following contact with the end surface of the running rail, follows to the right as opening of the sliding door is continued.

FIGS. 4 to 6 illustrate a second embodiment of the carrier 1*, part of the housing 3 having been left out in these figures. In the case of this embodiment, the second carrying arm 5' has just a single plate or two plates resting right up against one another. FIG. 4 shows the carrier 1* in that position in which the sliding door is closed. FIG. 5 shows this carrier in an intermediate position, and FIG. 6 shows this carrier in that position in which the sliding door is open.

Figures 7, 8, 9:
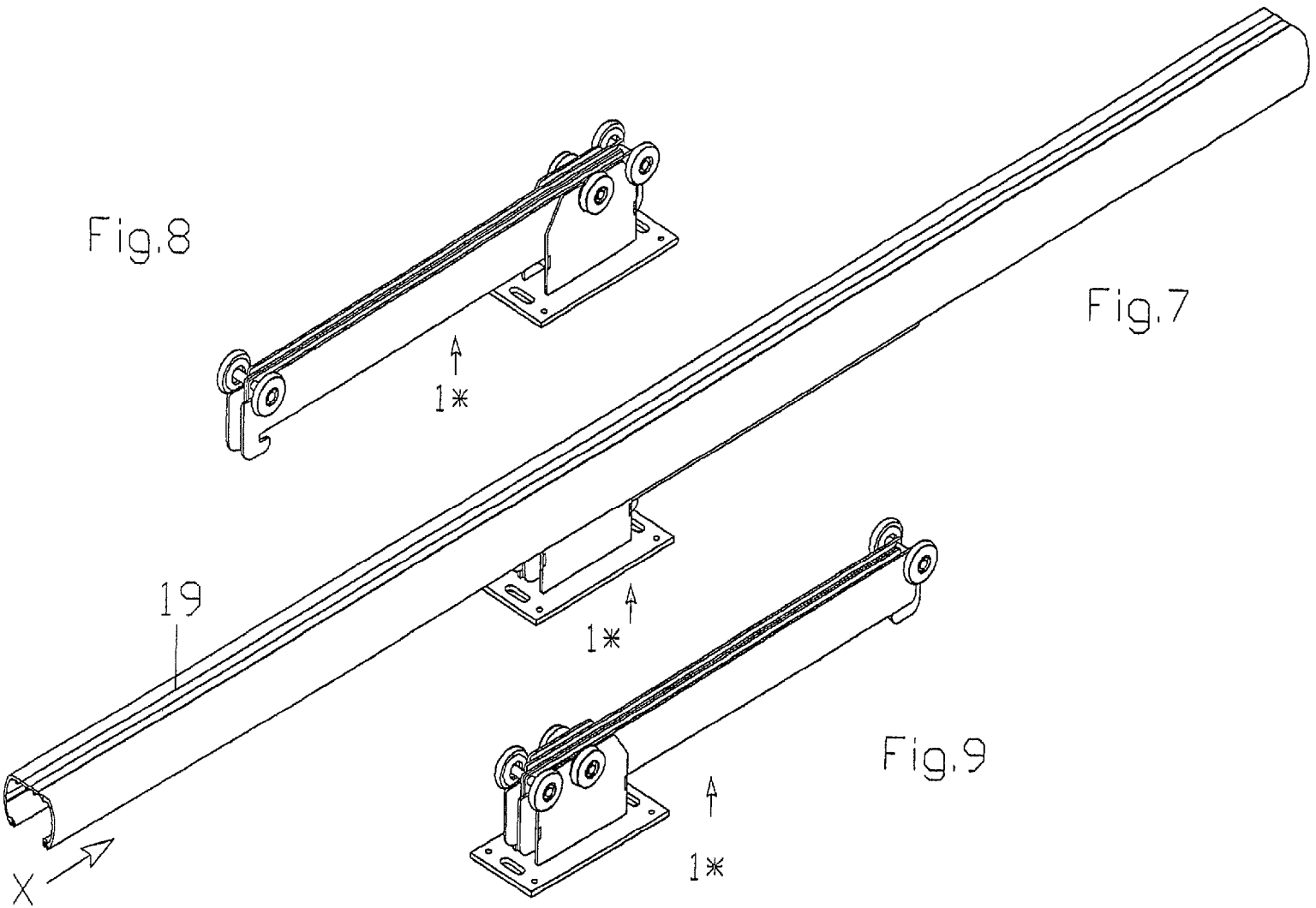
FIG. 7 shows a perspective view of a carrier and of a running-rail profile sliding thereon.
FIG. 8 shows a partial view, in perspective, of the carrier from FIG. 4 in the closed door position.
FIG. 9 shows a partial view, in perspective, of the carrier from FIG. 6 in the open door position.

FIG. 7 shows the carrier 1* and a running-rail profile 19 which slides thereon and can accommodate door walls or lattices. FIG. 8 shows the carrier 1* in that position in which the sliding door is closed, while FIG. 9 shows the carrier 1* in that position in which the sliding door is open.

Figure 10:
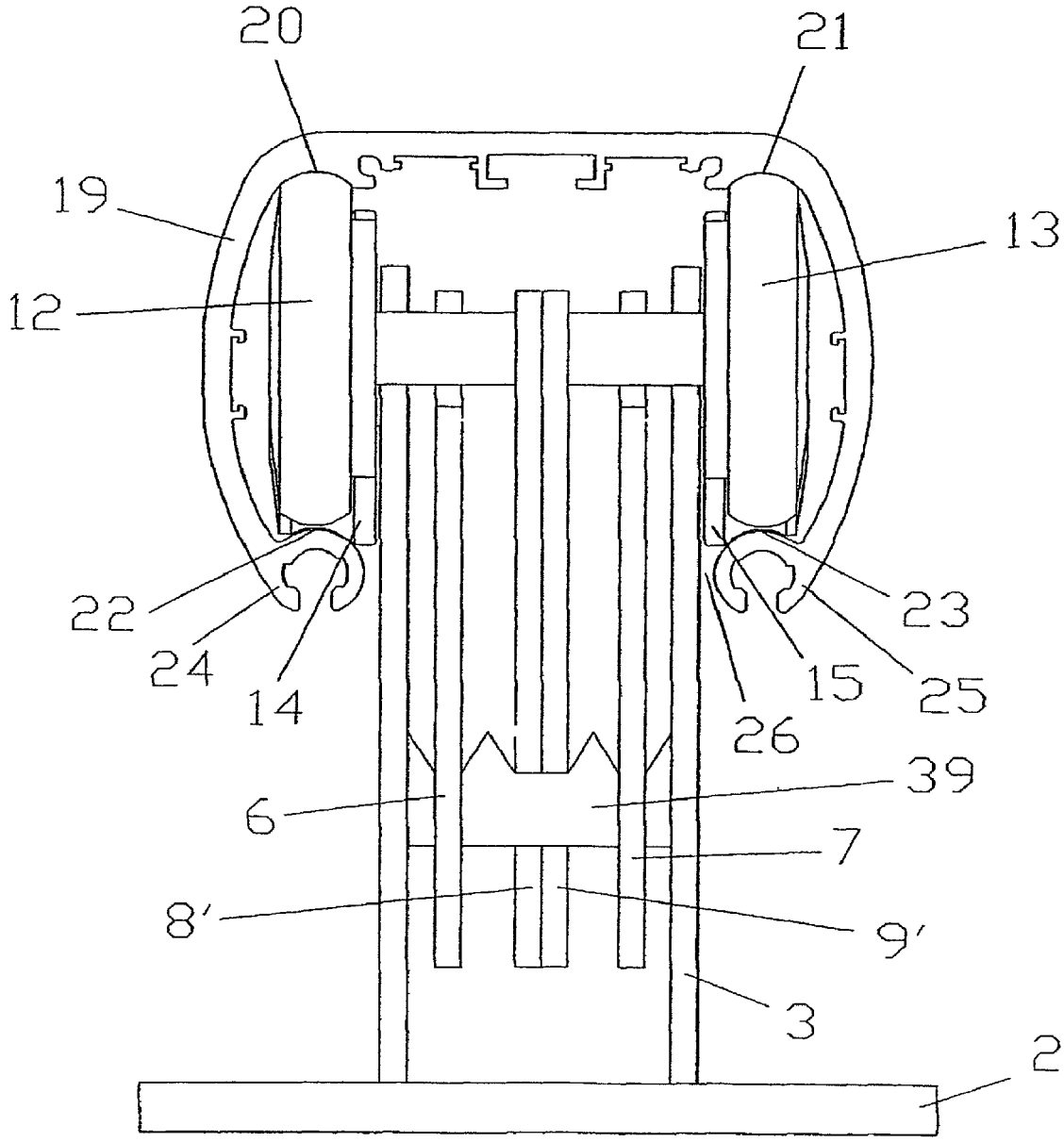
FIG. 10 shows an enlarged end view of the carrier and of the running-rail profile in the direction X in FIG. 7.

In FIG. 10, the running-rail profile has two longitudinal grooves 20, 21 in which the rollers 10, 11, and the rollers 12, 13, are guided. The rollers 14, may be guided on bottom ribs 22, 23, which, at the same time, form claws 24, 25 for accommodating door accessories or rail-connecting elements. In contrast to the embodiment of FIGS. 1 to 3, the second plates 8', 9' here are not spaced apart from one another. The running-rail profile 19 is open at the bottom (cf. longitudinal slot 26), in which case the housing 3 can project in here.

There are various possible ways of moving the movable roller carrier into its operating position. In many cases, it is advantageous to use gravitational force for pulling-out and/or pushing-out purposes. For example, a weight can be raised via a carrying cable, which is deflected by means of pulleys, as the roller carrier is pushed in. The pushing-out movement then takes place in a weight-induced manner. The disadvantage here for many applications is that the mechanism cannot be accommodated in its entirety within the running rail. A number of expedient, space-saving drive arrangements will be explained hereinbelow by way of representation.

Figure 11:
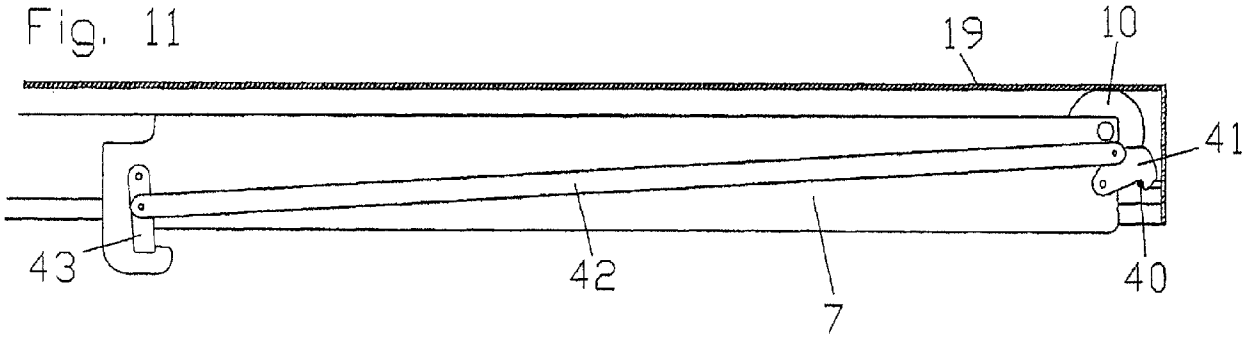
FIG. 11 shows a side view of a mechanism for pulling out a movable roller carrier.

FIG. 11 shows a mechanism for pulling out a movable roller carrier. The mechanism comprises a retaining bracket 40, which is connected to the running-rail profile 19, also comprises a hook 41, which engages in the retaining bracket 40, and further comprises a switch rod 42, which is connected to the hook 41 and to a triggering lever 43. If the door moves in the arrow direction, the movable roller carrier 7 is carried along with the door until the triggering lever 43 strikes against the housing 3 and, by means of the switch rod 42, activates the hook 41. The roller carrier 7, which is then located in its operating position, is thus uncoupled from the door. The running-rail profile 19 can continue its movement, positions itself on the movable roller carrier 7 under the weight of the door and thus also effects precise alignment in accordance with the directing combs 39. During movement in the opposite direction, the retaining bracket 40 engages in the hook 41 again and pushes the movable roller carrier 7 back again into its starting position. If a further movable roller carrier is provided for the opposite side, then the same sequences take place correspondingly.

Figure 12:
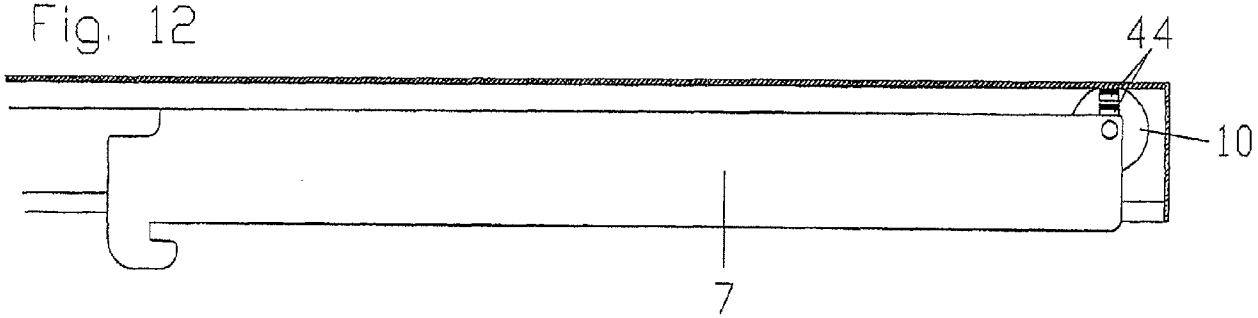
FIG. 12 shows a side view of a magnet-operated disengaging mechanism for a movable roller carrier.

FIG. 12 shows a magnet-operated disengaging mechanism. If a magnetic attachment element (magnet+magnet 44 or magnet+iron) is fitted on the outer sides of the movable roller carriers 7 and of the running-rail profile 19, the disengaging operation can be realized very straightforwardly by the movable roller carrier 7 being coupled magnetically to the running-rail profile 19 of the door. Uncoupling can take place simply by virtue of the force of attachment being overcome. In some cases, this may result in the occurrence of load peaks (pole sensitivity), although these can be avoided by using switchable magnets (for example electromagnets).

Figure 13:
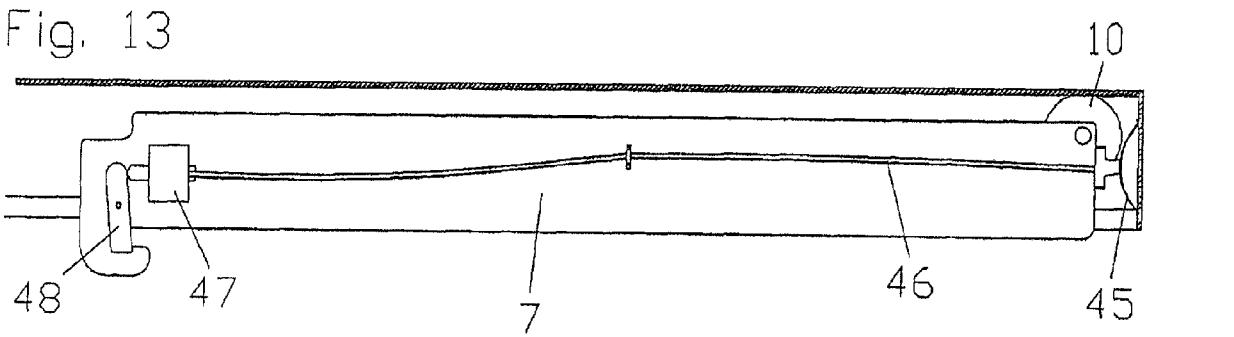
FIG. 13 shows a side view of a suction-operated disengaging mechanism for a movable roller carrier.

FIG. 13 shows a suction-operated disengaging mechanism. The movable roller carrier 7 has fitted on it a suction device 45 (suction cup) which couples upon contact with the smooth end side of the running-rail profile 19 and uncouples, by means of an air-admission hose 46, an air-admission valve 47 and an associated control lever 48, as the operating position is reached.

Figure 14:
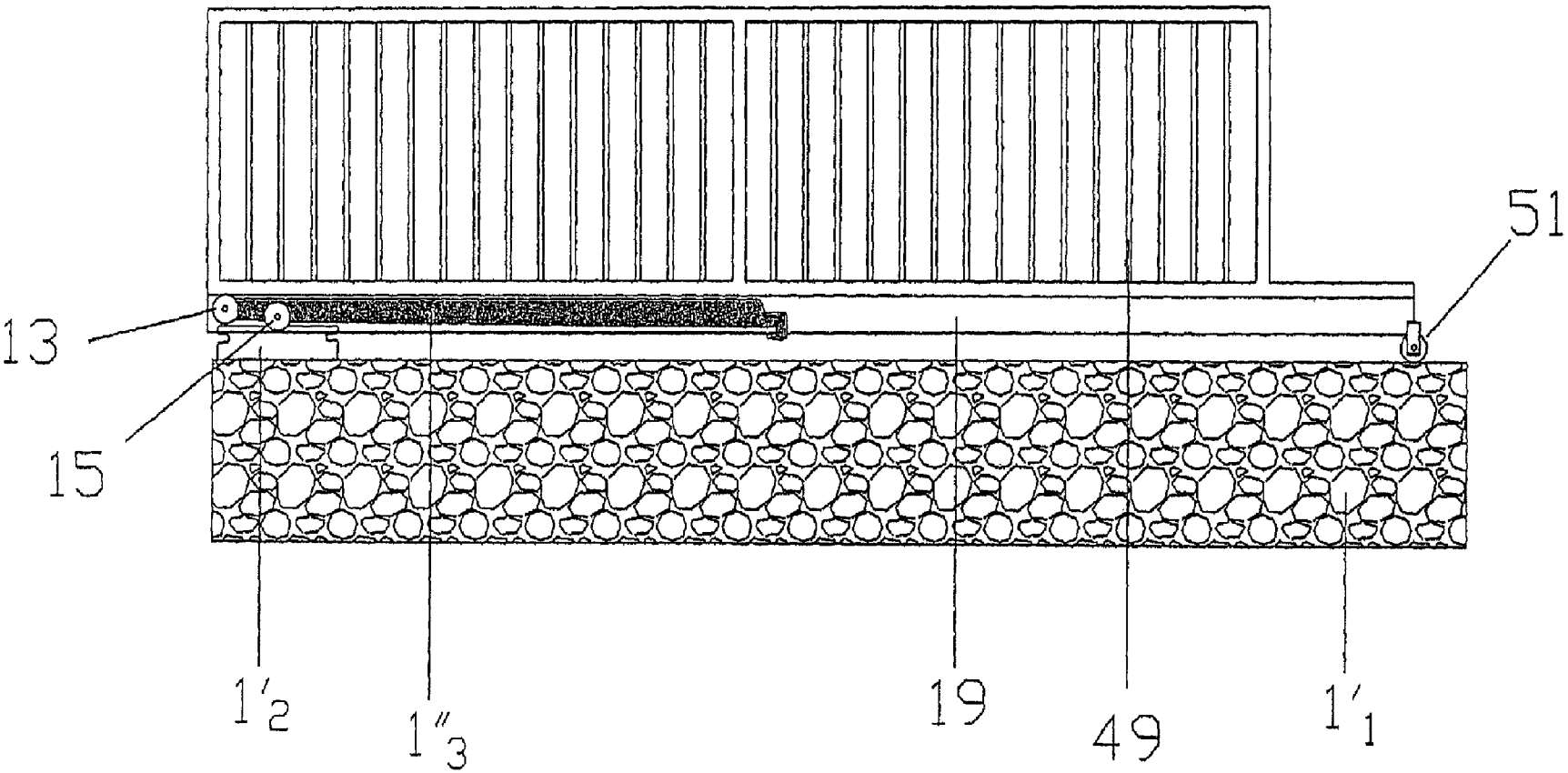
FIG. 14 shows a side view of a sliding door according to the invention similar to the embodiment in FIGS. 17*a*-17*c*, with an accompanying supporting roller in the open direction.

FIG. 14 illustrates a further embodiment of the guiding mechanism according to the invention, in which a door 49 which is self-supporting only in the closed direction (as is also the case in FIGS. 17*a*-17*c*) is guided by way of a running-rail profile 19. The door 49 is shown in the open position (similar to FIG. 17*c*). As can be seen, the supporting roller (53 in FIG. 17*c*) which is responsible for the opening movement, and is fixed on the ground, has been replaced in FIG. 14 by a supporting roller 51 which accompanies the door movement. The accompanying supporting roller 51 is guided along the ground here, but, for many applications, may also be guided preferably in a dedicated running rail mounted in a stationary manner.

This variant is particularly advantageous, inter alia, if the proposed guiding arrangement is used for drawer applications. In this context, it may be advantageous for the running rail to be configured with a number of tracks, in which case one track is available for the stationary roller carrier and another track is available for the movable roller carrier.

Figure 19C:
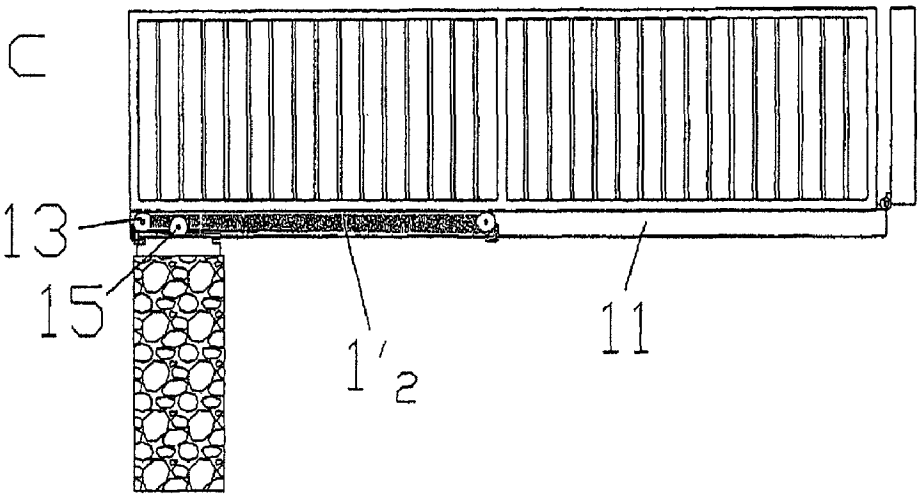
FIGS. 19*a*-19*c* show schematic side views of a door with a further embodiment of a guiding mechanism according to the invention.
Figure 19B:
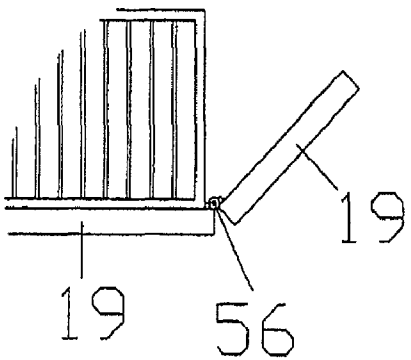
Figure 19A:
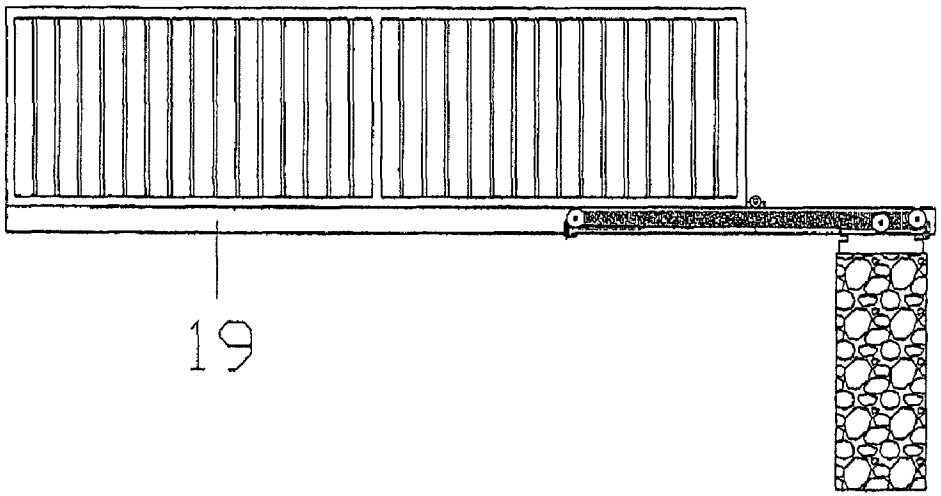

If there is a need for a system which allows a full pulling-out movement or more, this can, of course, be achieved, in a manner analogous to known systems, by using a combination of two or more guiding arrangements according to the invention. A further configuration which is advantageous in this context consists in the end of the running rail, or at least one running surface (track), being extensible, by means of a suitable mechanism, as it moves, in order thus to allow a correspondingly longer movement path. FIG. 19 shows a possible mechanism of this type embodied as a swing-action mechanism. As can be gathered from the view, in detail form, in FIG. 19*b*, for example a hinge 56 is fitted here on the top edge of the running rail. For the closing movement, the extension piece has to be swung downward in good time and, for the opening movement, it has to be swung upward at the correct time. This mechanism is controlled and driven manually or using known technical devices.

If an embodiment provides just one movable roller carrier for moving, for example, in the closing direction, a supporting roller or a similar measure has to be provided in the opening direction.

If an embodiment provides just a single movable roller carrier for both movement directions, an additional measure has to ensure that displacement of the movable roller carrier into its operating position can take place, according to the invention, in a manner essentially free of load moments. In this case, the stationary roller carrier alone performs the task of guiding the running rail to the extent which is necessary for the period of carrying-arm displacement. An advantageous possibility, in this context, is to use a curved lifting track on the running rail. A further such suitable measure may comprise, for example, a raising mechanism fitted in the region of the stationary roller carrier. This mechanism may comprise active, motor-operated lifting elements or straightforward lifting guides on the running rail. In the case of this last-mentioned embodiment, thickened portions provided on the underside or inside of the running rails move, as the door itself moves, over rollers provided for this purpose on the stationary roller carrier and raise the running rail slightly. The movable roller carrier can then be displaced into its other operating position without any great amount of force being applied. It is necessary for this movable roller carrier to be correspondingly fitted at both ends with running rollers and to be suitable for being anchored according to the invention in the operating position at both ends. It is likewise possible for a lowering movement of the bearing elements or of the running rollers to be utilized in order to displace a movable roller carrier in a manner more or less free of load moments. The lowering and raising movements can take place in a variety of different ways using the known technical devices, for example using magnetic, hydraulic, pneumatic or mechanical arrangements. The advantage of these variants is the possibility of configuring the sliding-action arrangement in a height-adaptable manner, that is to say of achieving different height positions in the open and closed states.

In contrast to all the known guiding mechanisms, the variants according to the invention make use of at least one movable roller carrier in the form of a carrying arm which, in its operating position, can absorb forces via rollers or sliding elements provided for this purpose and dissipate them, on the opposite side, via the bearing location and/or the anchoring location. The characteristic feature here is that there is no relative movement between the carrying arm and bearing elements at the bearing locations in the highly loaded state.

A movable carrying arm may also be provided with additional rollers, approximately on the anchoring side, in order not to slide along the bearing locations as it is displaced.

Free of load moments here means a range from not subjected to loading to subjected to weight-induced loading by a force which is not significantly higher than the weight, that is to say is not multiplied by the lever factor.

Operating position is intended to mean that position or positions in which a movable roller carrier can absorb, and dissipate, forces by being anchored.

The essential advantages of the invention used for self-supporting sliding doors may be summarized as follows:

1. The door leaf is shortened because the clamping-in part is virtually completely done away with. This results in savings in respect of materials, transporting costs and coating costs, and the amount of space required for installation is reduced.

2. The freely projecting length of the door leaf, for a comparable through-passage width, is smaller. The door leaf and the running rollers are subjected to less loading.

3. The foundation is reduced in size and thus becomes less expensive.

The door runs more easily—with all the accompanying positive effects on driving, securement and service life.

5. The door can be rendered more esthetically pleasing because it is possible to dispense with elements used for static stiffening purposes.

The invention claimed is:

1. A guiding mechanism for sliding-action arrangements comprising:

a running-rail profile having a longitudinal axis and being mounted for movement on a plurality of rollers or sliding elements;

a stationary roller carrier for mounting at least a part of the plurality of the rollers or sliding elements, whereby the at least a part of the plurality of rollers or sliding elements is carried by the stationary roller carrier; and at least one movable roller carrier for mounting at least another part of the plurality of rollers and sliding elements, the at least one movable roller carrier having a longitudinal axis disposed in an identical plane as the longitudinal axis of the running rail-profile, and being movable and essentially free of load moments along a direction of the longitudinal axis of the running rail profile during movement into an operating end position by moving with the running-rail profile until reaching the operating end position and uncoupling from the running-rail profile in the operating end position thereby supporting the running rail-profile during further movement.

2. The guiding mechanism as claimed in claim 1, wherein the at least one movable roller carrier is mounted in a displaceable manner in a housing of the stationary roller carrier that structured to be one of open, partially open or closed, and the at least one movable carrier is anchorable in its operating position.

3. The guiding mechanism as claimed in claim 1, wherein the at least one movable roller carrier comprises a first movable roller carrier and a second movable roller carrier, and the second movable carrier is mounted to be displaceable in an opposite direction to the first movable roller carrier and is anchorable in its operating position.

4. The guiding mechanism as claimed in claim 1, wherein the at least one movable roller carrier is accommodated at least one of wholly and partially in the running-rail profile and is movable by suitable control and drive elements into its operating position.

5. The guiding mechanism as claimed in claim 1, wherein the movable roller carrier is recessible one of wholly and partially in a ground surface and is movable, by a suitable control, coupling and drive elements, into the operating position.

6. The guiding mechanism as claimed in claim 1, wherein one or more rollers are adjustable at least one of vertically and horizontally on the stationary roller carrier.

7. The guiding mechanism of claim 1 being structured and arranged for sliding-action arrangements in one of leaves and doors.

8. The guiding mechanism of claim 1, wherein at least one running surface of the running rail profile is extendible during a movement cycle.

9. The guiding mechanism of claim 8, wherein the running surface is extended by one of a swing action and pivoting mechanism.

10. The guiding mechanism of claim 1, wherein at least one other of the plurality of rollers and sliding elements is carried by the at least one movable roller carrier.

11. A guiding mechanism for sliding-action arrangements comprising:

a running-rail profile having a longitudinal axis and being mounted on rollers or sliding elements;

a stationary roller carrier coupled to at least one of the rollers or sliding elements; and at least one movable roller carrier for mounting at least one other of the plurality of rollers and sliding elements, the at least one movable roller carrier having a longitudinal axis disposed in an identical plane as the longitudinal axis of the running rail profile, and being movable and free of load moments along a direction of the longitudinal axis of the running rail profile during movement into an operating end position by moving with the running-rail profile until reaching the operating end position and uncoupling from the running-rail profile in the operating end position while supporting the running rail-profile during further movement, wherein the at least one movable roller carrier is mounted in a displaceable manner in a housing of the stationary roller carrier that structured to be one of open, partially open or closed, and the at least one movable carrier is anchorable in its operating position, wherein the stationary carrier has an elongate housing which is in a form of an upright rectangle in cross section, wherein a first carrying arm and a second carrying arm are guided in the housing such that they can be displaced in relation to one another and, at opposite ends in each case, bear a pair of rollers, and wherein the first carrying arm comprises two spaced-apart, parallel and interconnected first plates, between which the second carrying arm is arranged.

12. The guiding mechanism as claimed in claim 11, wherein the second carrying arm comprises two spaced-apart, parallel and interconnected second plates.

13. The guiding mechanism as claimed in claim 11, wherein the carrying arms are guided on bearings fitted in the housing.

14. The guiding mechanism as claimed in claim 13, wherein the bearings are roller bearings.

15. The guiding mechanism as claimed in claim 11, wherein the carrier comprises an installation plate which can be fastened on a ground surface and bears the housing.

16. The guiding mechanism of claim 11, wherein a pair of rollers is fitted in a stationary manner on the housing.

17. The guiding mechanism of claim 16, wherein the pair of rollers is fitted on the housing such that it is adjustable in the longitudinal direction.

18. A guiding mechanism for sliding-action arrangements comprising:

a running-rail profile having a longitudinal axis and being mounted on rollers or sliding elements;

a stationary roller carrier coupled to at least one of the rollers or sliding elements; and at least one movable roller carrier for mounting at least one other of the plurality of rollers and sliding elements, the at least one movable roller carrier having a longitudinal axis disposed in an identical plane as the longitudinal axis of the running rail profile, and being movable and free of load moments along a direction of the longitudinal axis of the running rail profile during movement into an operating end position by moving with the running-rail profile until reaching the operating end position and uncoupling from the running-rail profile in the operating end position while supporting the running rail-profile during further movement, wherein the running rail profile contains dedicated running surfaces on which the at least one roller of the stationary roller carrier is arranged to run and additional running surfaces on which the at least one roller of the movable roller carriers is arranged to run.

* * * * *